US008984888B2

(12) United States Patent
Uhm et al.

(10) Patent No.: US 8,984,888 B2
(45) Date of Patent: Mar. 24, 2015

(54) FUEL INJECTION ASSEMBLY FOR USE IN TURBINE ENGINES AND METHOD OF ASSEMBLING SAME

(75) Inventors: Jong Ho Uhm, Simpsonville, SC (US); Thomas Edward Johnson, Greer, SC (US)

(73) Assignee: General Electric Company, Schenectady, NY (US)

( * ) Notice: Subject to any disclaimer, the term of this patent is extended or adjusted under 35 U.S.C. 154(b) by 724 days.

(21) Appl. No.: 13/281,679

(22) Filed: Oct. 26, 2011

(65) Prior Publication Data

US 2013/0104551 A1 May 2, 2013

(51) Int. Cl.

| | |
|---|---|
| ***F02C 1/00*** | (2006.01) |
| ***F02G 3/00*** | (2006.01) |
| ***F23R 3/28*** | (2006.01) |
| ***F23R 3/10*** | (2006.01) |
| *F23R 3/34* | (2006.01) |

(52) U.S. Cl.

CPC ..... *F23R 3/283* (2013.01); *Y10T 29/49231* (2015.01); *F23R 3/34* (2013.01); *F23R 3/346* (2013.01); *F23R 3/10* (2013.01)

USPC ..... 60/737

(58) Field of Classification Search

CPC ..... F02C 7/22; F02C 7/222; F02C 7/228; F23R 3/34; F23R 3/346; F23R 3/286; F23R 3/36

USPC ..... 60/737, 740, 742, 746, 747

See application file for complete search history.

(56) References Cited

U.S. PATENT DOCUMENTS

| | | | | |
|---|---|---|---|---|
| 4,729,217 | A | 3/1988 | Kehlhofer | |
| 4,833,881 | A | 5/1989 | Vdoviak et al. | |
| 4,893,468 | A | 1/1990 | Hines | |
| 4,927,349 | A | 5/1990 | Schirmer et al. | |
| 5,228,283 | A | 7/1993 | Sciocchetti | |
| 5,402,964 | A | 4/1995 | Wygananski | |
| 5,459,994 | A | 10/1995 | Drnevich | |
| 5,487,274 | A | 1/1996 | Gulati et al. | |
| 5,697,207 | A | 12/1997 | Cromer et al. | |
| 5,701,732 | A * | 12/1997 | Nesbitt et al. | 60/776 |
| 5,974,780 | A | 11/1999 | Santos | |
| 6,092,621 | A | 7/2000 | Kinzie | |
| 6,240,731 | B1 | 6/2001 | Hoke et al. | |
| 6,427,446 | B1 | 8/2002 | Kraft et al. | |
| 6,513,317 | B2 | 2/2003 | Arar et al. | |
| 6,519,945 | B2 | 2/2003 | Arar et al. | |
| 6,527,221 | B1 | 3/2003 | Kremeyer | |
| 6,622,488 | B2 * | 9/2003 | Mansour et al. | 60/740 |
| 6,837,456 | B1 | 1/2005 | Shih et al. | |

(Continued)

*Primary Examiner* — William H Rodriguez

(74) *Attorney, Agent, or Firm* — Armstrong Teasdale LLP

(57) ABSTRACT

A fuel injection assembly for use in a turbine engine is provided. The fuel injection assembly includes a plurality of tube assemblies, wherein each of the tube assemblies includes an upstream portion and a downstream portion. Each tube assembly includes a plurality of tubes that extend from the upstream portion to the downstream portion or from the upstream portion through the downstream portion. At least one injection system is coupled to at least one tube assembly of the plurality of tube assemblies. The injection system includes a fluid supply member that extends from a fluid source to the downstream portion of the tube assembly. The fluid supply member includes a first end portion located in the downstream portion of the tube assembly, wherein the first end portion has at least one first opening for channeling fluid through the tube assembly to facilitate reducing a temperature therein.

11 Claims, 7 Drawing Sheets

(56) References Cited

U.S. PATENT DOCUMENTS

| | | | | |
|---|---|---|---|---|
| 7,013,635 | B2 | 3/2006 | Cohen et al. | |
| 7,063,288 | B1 | 6/2006 | Kremeyer | |
| 7,121,511 | B2 | 10/2006 | Kremeyer | |
| 7,484,589 | B2 | 2/2009 | Guo | |
| 7,536,862 | B2 * | 5/2009 | Held et al. | 60/742 |
| 7,648,100 | B2 | 1/2010 | Kremeyer | |
| 7,650,744 | B2 | 1/2010 | Varatharajan et al. | |
| 7,802,434 | B2 | 9/2010 | Varatharajan et al. | |
| 7,886,545 | B2 | 2/2011 | Lacy et al. | |
| 7,895,841 | B2 | 3/2011 | Johnson et al. | |
| 7,900,457 | B2 | 3/2011 | Patterson et al. | |
| 7,954,328 | B2 | 6/2011 | Atassi | |
| 8,322,143 | B2 * | 12/2012 | Uhm et al. | 60/737 |
| 8,438,851 | B1 * | 5/2013 | Uhm et al. | 60/737 |
| 8,539,773 | B2 * | 9/2013 | Ziminsky et al. | 60/737 |
| 2006/0137352 | A1 | 6/2006 | Prasad | |
| 2007/0157621 | A1 | 7/2007 | Koshoffer et al. | |
| 2010/0186413 | A1 * | 7/2010 | Lacy et al. | 60/740 |
| 2012/0180487 | A1 * | 7/2012 | Uhm et al. | 60/737 |
| 2012/0180495 | A1 * | 7/2012 | Uhm et al. | 60/772 |
| 2013/0104552 | A1 * | 5/2013 | Uhm et al. | 60/738 |
| 2013/0199189 | A1 * | 8/2013 | Uhm et al. | 60/737 |
| 2013/0199190 | A1 * | 8/2013 | Uhm et al. | 60/740 |
| 2013/0227928 | A1 * | 9/2013 | Uhm et al. | 60/39.58 |
| 2013/0227955 | A1 * | 9/2013 | Uhm et al. | 60/775 |
| 2013/0299602 | A1 * | 11/2013 | Hughes et al. | 239/8 |
| 2013/0318975 | A1 * | 12/2013 | Stoia et al. | 60/737 |
| 2014/0157779 | A1 * | 6/2014 | Uhm et al. | 60/725 |

* cited by examiner

FUEL INJECTION ASSEMBLY FOR USE IN TURBINE ENGINES AND METHOD OF ASSEMBLING SAME

FEDERAL RESEARCH STATEMENT

This invention was made with Government support under Contract No. DE-FC26-05NT42643, awarded by the Department of Energy (DOE), and the Government has certain rights in this invention.

BACKGROUND OF THE INVENTION

The subject matter disclosed herein generally relates to turbine engines and, more particularly, to a fuel injection assembly for use in a turbine engine.

At least some known turbine engines are used in cogeneration facilities and power plants. Such engines may have high specific work and power per unit mass flow requirements. To increase the operating efficiency, at least some known turbine engines, such as gas turbine engines, operate with increased combustion temperatures. In at least some known gas turbine engines, engine efficiency increases as combustion gas temperatures increase.

However, operating with higher temperatures may also increase the generation of polluting emissions, such as oxides of nitrogen ($NO_X$). In an attempt to reduce the generation of such emissions, at least some known turbine engines include improved combustion system designs. For example, many combustion systems may use premixing technology that includes tube assemblies or micro-mixers that facilitate mixing substances, such as diluents, gases, and/or air with fuel to generate a fuel mixture for combustion.

However, the benefits of such combustion systems may be limited. Each tube assembly or micro-mixer has a substantially large recirculation region within its center area or large blockage area. More specifically, the combustion product that is recirculating in the center area interacts with the combustible mixture within each of the tubes in the tube assemblies that are located within the center area. As a result, the temperature within the recirculation region is substantially higher than other areas of the tube assembly or micro-mixer. The high temperature results in a reduced margin of a flashback and/or a flameholding in the tubes that are located in the recirculation region. Increased temperatures may also increase the wear of the combustor and its associated components, and/or may shorten the useful life of the combustion system.

BRIEF DESCRIPTION OF THE INVENTION

In one embodiment, a fuel injection assembly for use in a turbine engine is provided. The fuel injection assembly includes a plurality of tube assemblies, wherein each of the tube assemblies include an upstream portion and a downstream portion. Each of the tube assemblies include a plurality of tubes that extend from the upstream portion to the downstream portion or from the upstream portion through the downstream portion. At least one injection system is coupled to at least one tube assembly of the plurality of tube assemblies. The injection system includes a fluid supply member that extends from a fluid source to the downstream portion of the tube assembly. The fluid supply member includes a first end portion located in the downstream portion of the tube assembly, wherein the first end portion has at least one first opening for channeling fluid through the tube assembly to facilitate reducing a temperature therein.

In another embodiment, a turbine engine is provided. The turbine engine includes a compressor and a combustion assembly coupled downstream from the compressor. The combustion assembly includes at least one combustor that includes at least one fuel injection assembly. The fuel injection assembly includes a plurality of tube assemblies wherein each of the tube assemblies includes an upstream portion and a downstream portion. Each of the tube assemblies include a plurality of tubes that extend from the upstream portion to the downstream portion or from the upstream portion through the downstream portion. At least one injection system is coupled to at least one tube assembly of the plurality of tube assemblies. The injection system includes a fluid supply member that extends from a fluid source to the downstream portion of the tube assembly. The fluid supply member includes a first end portion located in the downstream portion of the tube assembly, wherein the first end portion has at least one first opening for channeling fluid to the tube assembly to facilitate reducing a temperature therein.

In yet another embodiment, a method of assembling a fuel injection assembly for use with a turbine engine is provided. A plurality of tube assemblies are coupled within a combustor, wherein each of the tube assemblies include an upstream portion and a downstream portion. Each of the plurality of tube assemblies includes a plurality of tubes that extend from the upstream portion to the downstream portion or from the upstream portion through the downstream portion. At least one injection system is coupled to at least one tube assembly of the plurality of tube assemblies. The injection system includes a fluid supply member that extends from a fluid source to the downstream portion of the tube assembly. The fluid supply member includes a first end portion located in the downstream portion of the tube assembly, wherein the first end portion includes at least one first opening for channeling fluid to the tube assembly to facilitate reducing a temperature therein.

DETAILED DESCRIPTION OF THE INVENTION

The exemplary apparatus, systems, and methods described herein overcome at least some known disadvantages associated with at least some known combustion systems of turbine engines that operate with higher temperatures. The embodiments described herein provide a fuel injection assembly that may be used with turbine engines to facilitate substantially reducing the temperature within the combustor. More specifically, the fuel injection assembly includes a plurality of tube assemblies, wherein each of the tube assemblies include an upstream portion and a downstream portion. Each of the tube assemblies include a plurality of tubes that extend from the upstream portion to the downstream portion or from the upstream portion through the downstream portion. At least one injection system is coupled to at least one tube assembly of the plurality of tube assemblies. The injection system includes a fluid supply member that extends from a fluid source to the downstream portion of the tube assembly. The fluid supply member includes a first end portion located in the downstream portion of the tube assembly, wherein the first end portion has at least one first opening for channeling fluid through the tube assembly to facilitate reducing a temperature therein. More specifically, channeling the fluid to at least one of the tube assemblies facilitates reducing the temperature in the center area of tube assembly and of the tubes positioned within the center area, and reducing the probability of or preventing flashbacks and/or flameholdings within the tube.

Figure 1:
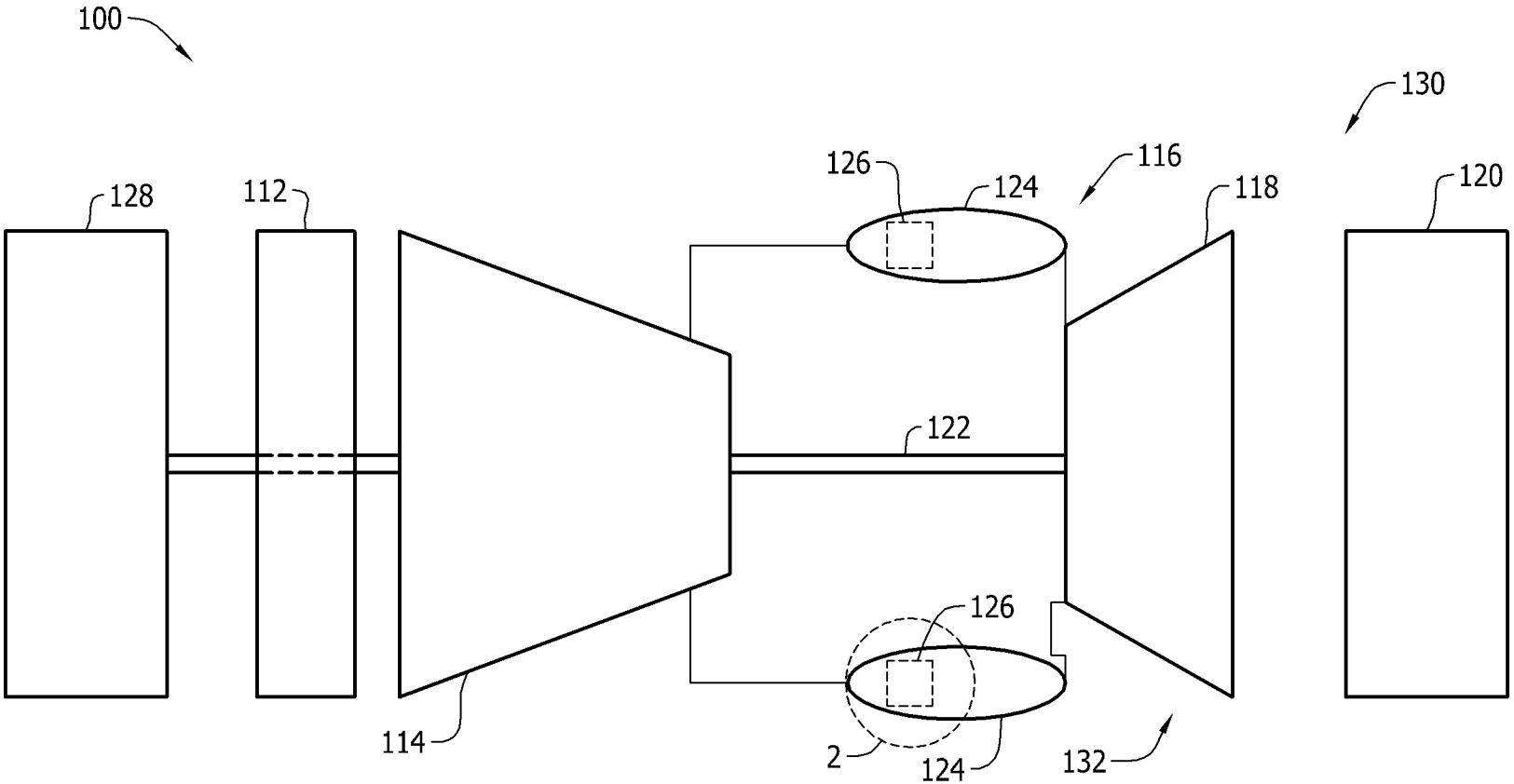
FIG. 1 is a schematic cross-sectional view of an exemplary turbine engine.

FIG. 1 is a schematic cross-sectional view of an exemplary turbine engine 100. More specifically, turbine engine 100 is a gas turbine engine. While the exemplary embodiment includes a gas turbine engine, the present invention is not limited to any one particular engine, and one of ordinary skill in the art will appreciate that the current invention may be used in connection with other turbine engines.

Moreover, in the exemplary embodiment, turbine engine 100 includes an intake section 112, a compressor section 114 coupled downstream from intake section 112, a combustor section 116 coupled downstream from compressor section 114, a turbine section 118 coupled downstream from combustor section 116, and an exhaust section 120. Turbine section 118 is coupled to compressor section 114 via a rotor shaft 122. In the exemplary embodiment, combustor section 116 includes a plurality of combustors 124. Combustor section 116 is coupled to compressor section 114 such that each combustor 124 is positioned in flow communication with the compressor section 114. A fuel injection assembly 126 is coupled within each combustor 124. Turbine section 118 is coupled to compressor section 114 and to a load 128 such as, but not limited to, an electrical generator and/or a mechanical drive application. In the exemplary embodiment, each compressor section 114 and turbine section 118 includes at least one rotor disk assembly 130 that is coupled to a rotor shaft 122 to form a rotor assembly 132.

During operation, intake section 112 channels air towards compressor section 114 wherein the air is compressed to a higher pressure and temperature prior to being discharged towards combustor section 116. The compressed air is mixed with fuel and other fluids that are provided by each fuel injection assembly 126 and ignited to generate combustion gases that are channeled towards turbine section 118. More specifically, each fuel injection assembly 126 injects fuel, such as natural gas and/or fuel oil, air, and/or diluents, such as Nitrogen gas ($N_2$) in respective combustors 124, and into the air flow. The fuel mixture is ignited to generate high temperature combustion gases that are channeled towards turbine section 118. Turbine section 118 converts the thermal energy from the gas stream to mechanical rotational energy, as the combustion gases impart rotational energy to turbine section 118 and to rotor assembly 132. By having each fuel injection assembly 126 inject the fuel with air and/or diluents in respective combustors 124, the temperature may be reduced within each combustor 124.

Figure 2:
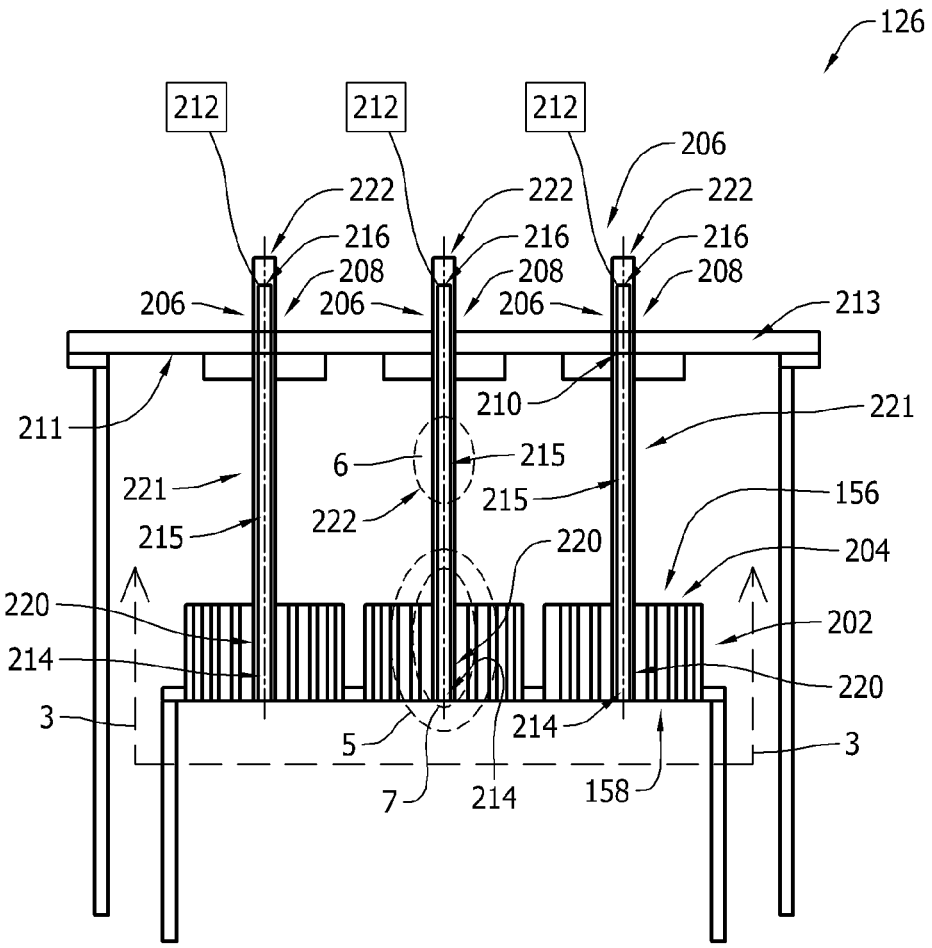
FIG. 2 is a schematic cross-sectional view of an exemplary fuel injection assembly that may be used with the turbine engine shown in FIG. 1 and taken along area 2.

FIG. 2 is a cross-sectional view of a portion of fuel injection assembly 126 and taken along area 2 (shown in FIG. 1). In the exemplary embodiment, fuel injection assembly 126 includes a plurality of tube assemblies 202, wherein each tube assembly 202 includes an upstream portion 156 and a downstream portion 158. Each tube assembly 202 includes a plurality of tubes 204 that extend from upstream portion 156 to downstream portion 158. In the exemplary embodiment, tube assemblies 202 are fuel injection nozzles that are each substantially axially coupled within combustor 124 (shown in FIG. 1). Tube assemblies 202 may be formed integrally within combustor 124 or tube assemblies 202 may be coupled to combustor 124. In the exemplary embodiment, each tube 204 discharges a mixture of fuel, air, and other fluids that are channeled through a passage (not shown) within each tube 204.

Fuel injection assembly 126 also includes at least one injection system 206. More specifically, in the exemplary embodiment, each tube assembly 202 is coupled to one injection system 206. Injection system 206, in the exemplary embodiment, includes a fuel delivery pipe 208 and a fluid supply member 210 that is positioned at least partially within fuel delivery pipe 208. Alternatively, fluid supply member 210 may be positioned in any other location with respect to fuel delivery pipe 208, such as adjacent to fuel delivery pipe 208, and enables fuel injection assembly 126 and/or turbine engine 100 (shown in FIG. 1) to function as described herein.

In the exemplary embodiment, fluid supply member 210 extends from a fluid source 212 and extends through an end cover 213 of combustor 124 to downstream portion 158 of tube assembly 202. Alternatively, fluid supply member 210 may extend from a downstream surface 211 of end cover 213 or from a middle portion 215 of fluid supply member to downstream portion 158 of tube assembly 202. Fluid supply member 210, in the exemplary embodiment, includes a first end portion 214 coupled within tube assembly 202, a middle portion 215, and a second end portion 216 that is coupled to fluid source 212. Fluid source 212, in the exemplary embodiment, may include air, an inert gas, and/or a diluent, such as Nitrogen gas ($N_2$), Carbon Dioxide ($CO_2$), and/or steam. First end portion 214, in the exemplary embodiment, includes at least one first opening (not shown in FIG. 2) for channeling fluid to tube assembly 202.

Similarly, fuel delivery pipe 208 includes a first end portion 220 that is coupled to tube assembly 202, a middle portion 221, and a second end portion 222 that is coupled to a fuel source (not shown). In the exemplary embodiment, middle portion 221 of fuel delivery pipe 208 has a substantially cylindrical shape and is sized such that fluid supply member 210 may be positioned therein. Middle portion 215 of fluid supply member 210 also has a substantially cylindrical shape and is sized to be positioned within fuel delivery pipe 208.

Alternatively, fuel delivery pipe 208 and fluid supply member 210, and any portions of fuel delivery pipe 208 and fluid supply member 210 may have any other shape and/or size that enables fuel injection assembly 126 and/or turbine engine 100 to function as described herein.

Figure 3:
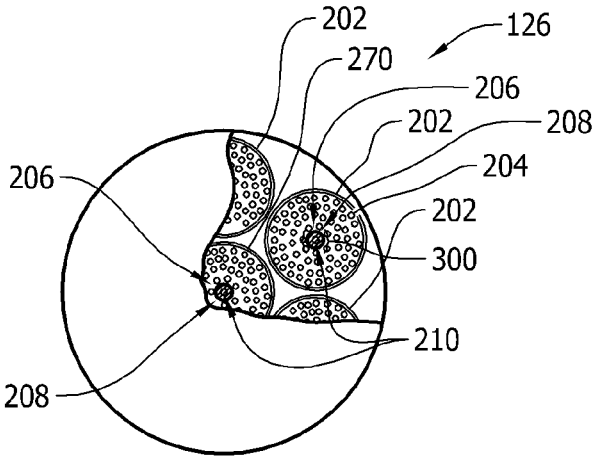
FIG. 3 is a schematic cross-sectional view of the fuel injection assembly shown in FIG. 2 and taken along line 3-3.
Figure 4:
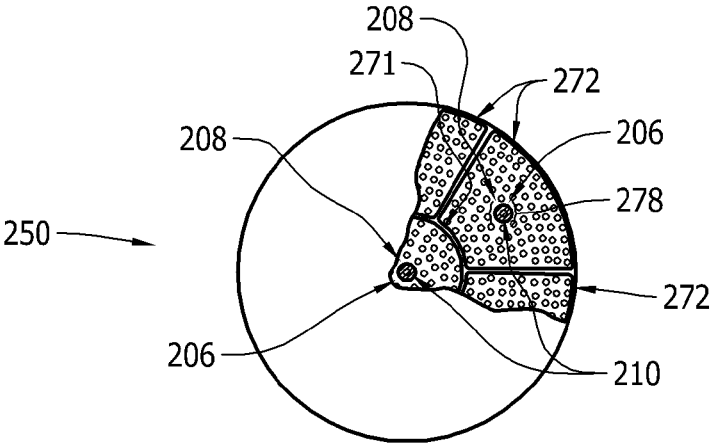
FIG. 4 is a schematic cross-sectional view of an alternative fuel injection assembly and also taken along line 3-3 (shown in FIG. 2)

FIG. 3 is a schematic cross-sectional view of fuel injection assembly 126 taken along line 3-3 (shown in FIG. 2). FIG. 4 is a schematic cross-sectional view of an alternative fuel injection assembly 250 that may be used with turbine engine 100 taken along line 3-3 (shown in FIG. 2). Referring to FIG. 3, in the exemplary embodiment, tube assemblies 202 include a central tube assembly 270, wherein each tube assembly 202 and 270 are substantially circular. Alternatively, tube assemblies 202 and 270 may be any other shape that enables tube assemblies 202 and 270 to function as described herein.

Moreover, the tubes 204 contained within each tube assembly 202 and 270 are spaced circumferentially therein. In the exemplary embodiment, each tube assembly 202 and 270 can have any number of tubes 204 that enables each tube assembly 202 and 270 to function as described herein. In the exemplary embodiment, tube assemblies 202 are spaced circumferentially about central tube assembly 270.

Alternatively, tube assemblies 202 may be arranged in any orientation that enables tube assemblies 202 to function as described herein. For example, as illustrated in FIG. 4, fuel injection assembly 250 includes a central tube assembly 271 and outer tube assemblies 272. In the exemplary embodiment, central tube assembly 271 is substantially circular and outer tube assemblies 272 have a substantially truncated-pie sector shape. Moreover, outer tube assemblies 272 each extend radially outwardly from central tube assembly 271.

Moreover, referring to FIG. 3, each tube assembly 202 is coupled to one injection system 206. More specifically, injection system 206 is positioned within a center region or area 300 of each tube assembly 202. Accordingly, fuel delivery pipe 208 and fluid supply member 210 are each positioned in the center area 300 within each tube assembly 202 such that fluid supply member 210 is coupled in flow communication between fluid source 212 (shown in FIG. 2) and tube assembly 202, allowing for fluid to be discharged into at least one first opening (not shown in FIGS. 3 and 4). Similarly, in FIG. 4, one injection system 206 is coupled to each of the central tube assembly 271 and outer tube assemblies 272. More specifically, each injection system 206 is positioned in a center region or area 278 of each tube assembly 271 and 272. Accordingly, fuel delivery pipe 208 and fluid supply member 210 are each positioned in the center area 278 within each tube assembly 271 and 272.

Figure 5:
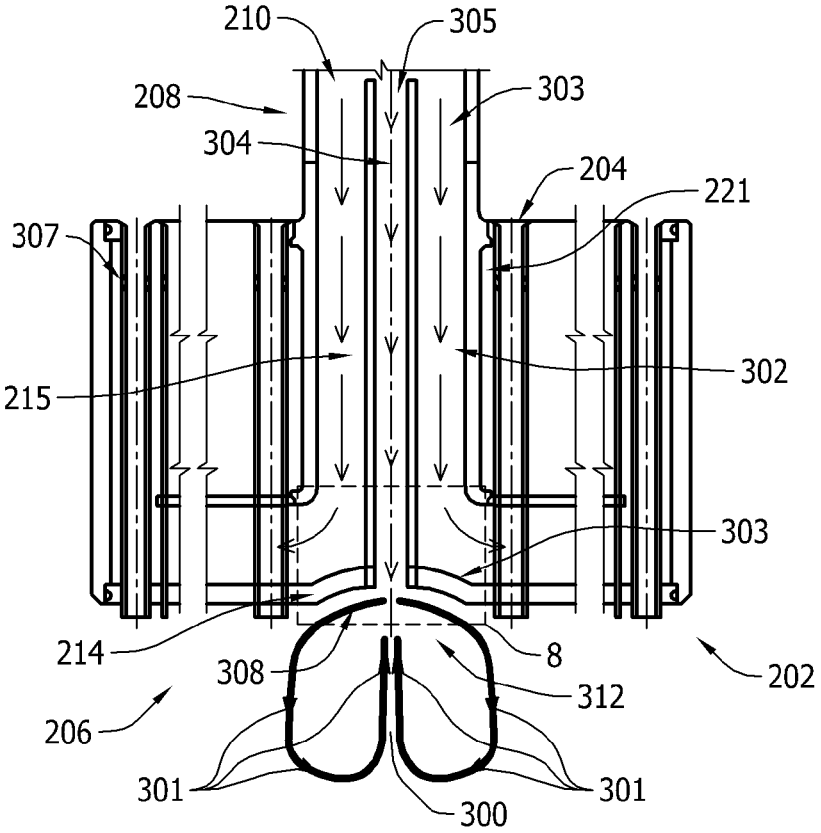
FIG. 5 is an enlarged schematic cross-sectional view of a portion of an exemplary injection system that may be used with the fuel injection assembly shown in FIG. 2 and taken along area 5.
Figure 6:
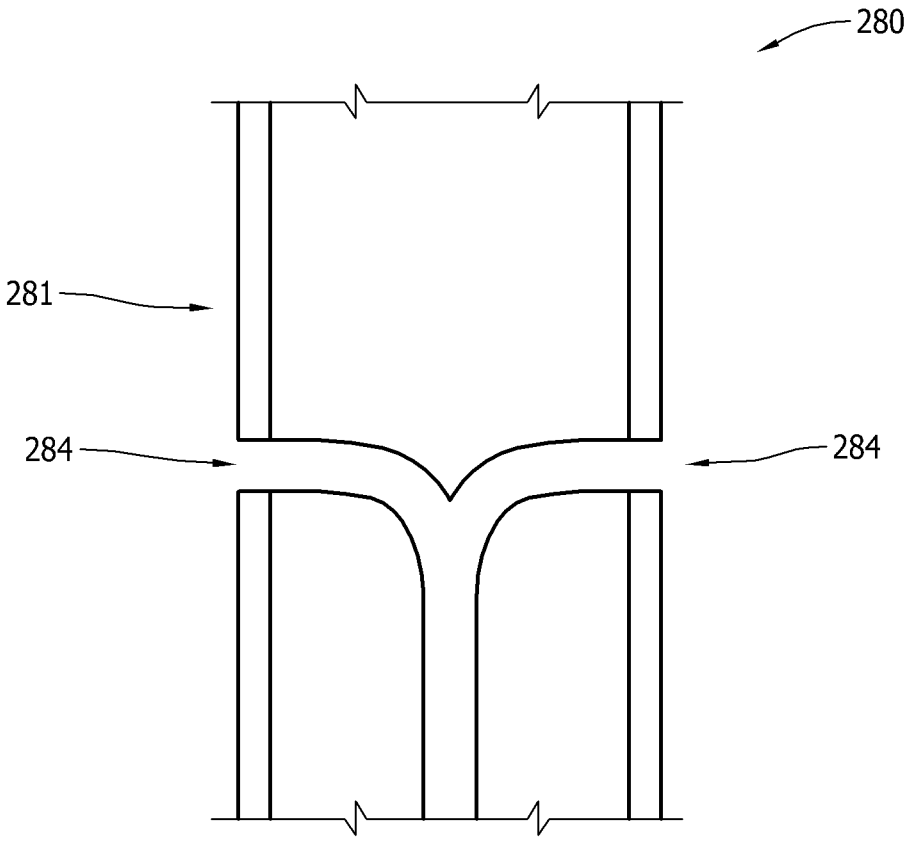
FIG. 6 is an enlarged schematic cross-sectional view of a portion of an alternative injection system that may be used with the fuel injection assembly shown in FIG. 2 and taken along area 6.
Figure 7:
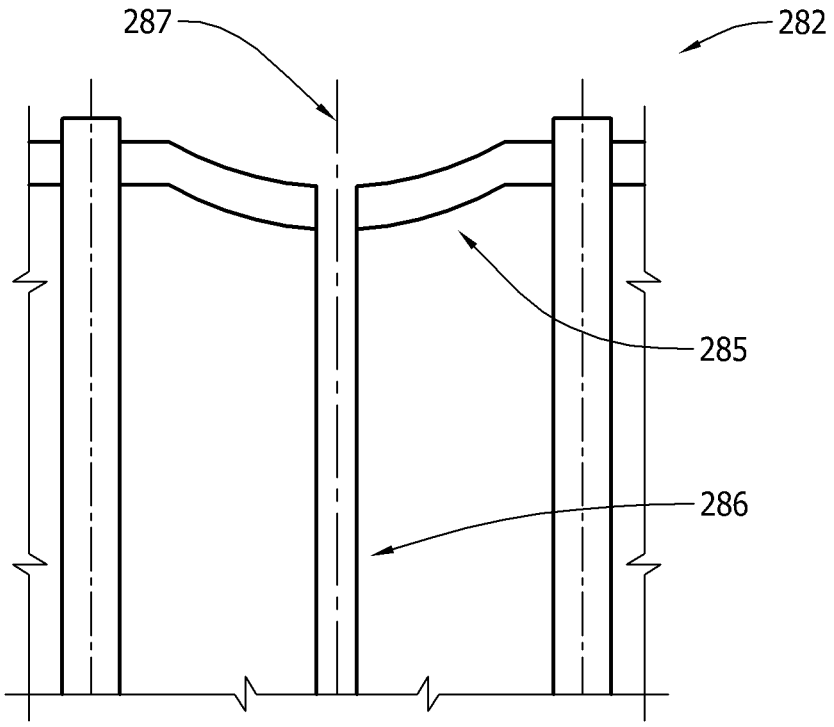
FIG. 7 is an enlarged schematic cross-sectional view of a portion of another alternative injection system that may be used with the fuel injection assembly shown in FIG. 2 and taken along area 7.
Figure 8:
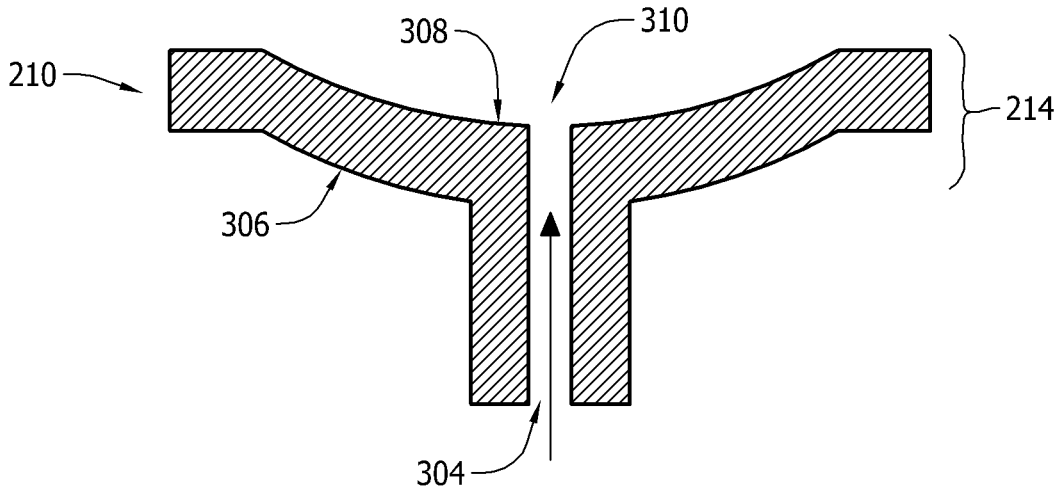
FIG. 8 is an enlarged schematic cross-sectional view of a portion of an exemplary fluid supply member that may be used with the injection system shown in FIG. 5 and taken along area 8.

FIG. 5 is an enlarged schematic cross-sectional view of injection system 206 with tube assembly 202 and taken along area 5 (shown in FIG. 2). FIG. 6 is an enlarged schematic cross-sectional view of a portion of an alternative injection system 280 and taken along area 6 (shown in FIG. 2). FIG. 7 is an enlarged schematic cross-sectional view of a portion of another alternative injection system 282 and taken along area 7 (shown in FIG. 2). FIG. 8 is an enlarged schematic cross-sectional view of a portion of fluid supply member 210 taken along area 8 (shown in FIG. 5).

Referring to FIGS. 5 and 8, in the exemplary embodiment, injection system 206 is coupled approximately to center region or area 300 of tube assembly 202. In the exemplary embodiment, center area 300 is a recirculatation region wherein any fluids being channeled to tube assembly 202 is injected and disperses or blows recirculating hot combustion product and/or deforms a recirculation region (not shown), and is recirculated, as shown by arrows 301, such that the fluid remains within center area 300. Fuel delivery pipe 208 and fluid supply member 210 positioned therein are each coupled within center area 300.

A channel 302 is defined within fuel delivery pipe 208. More specifically, in the exemplary embodiment, channel 302 is defined within fuel delivery pipe 208, and provides a flow path, as shown by arrows 303, for the flow of fuel therein. Then the fuel is injected through at least an aperture 307 into each tube 204 and then mixes with air in the tube 204. A channel 304 is also defined within fluid supply member 210 and provides a flow path, as shown by arrows 305, for the flow of fluid therein. Alternatively, fuel delivery pipe 208 and/or fluid supply member 210 may each have a channel that provides any other type of flow path and that enables fuel injection assembly 126 and/or turbine engine 100 to function as described herein. In the exemplary embodiment, fluid is channeled from second end portion 216 (shown in FIG. 2) of fuel delivery pipe.

Alternatively, as illustrated in FIG. 6, fluid may be channeled from a middle portion 281 of a fluid supply member 283. More specifically, fluid from fluid source 212 (shown in FIG. 2) may channel fluid directly to at least one opening 284 of fluid supply member 283 that is located within middle portion 281.

Alternatively, as illustrated in FIG. 7, fluid may be channeled from a first end portion 285 of a fluid supply member 286. More specifically, fluid from fluid source 212 (shown in FIG. 2) may channel fluid directly to at least one opening 287 of fluid supply member 286 that is located within first end portion 285.

Referring to FIGS. 5 and 8, in the exemplary embodiment, first end portion 214 of fluid supply member 210 includes an upstream surface 306 and a downstream surface 308. First end portion 214 also includes at least one opening 310 that extends from channel 304. In the exemplary embodiment, upstream 306 and downstream surfaces 308 have a curved shape for facilitating fluid flow within tube assembly 202. More specifically, upstream 306 and downstream surfaces 308 have a substantially concave shape. Alternatively, upstream 306 and downstream surfaces 308 may have a different shape, such as a convex shape that enables fuel injection assembly 126 and/or turbine engine 100 to function as described herein.

During operation, fuel is channeled through fuel delivery pipe 208 and supplied to tube assembly 202, wherein the fuel is mixed with air to form a combustible mixture in tubes 204. Hot combustion product is recirculated within center area 300 is in contact with tubes 204 that located within center area 300 and also interacts with some combustible mixture from tubes 204. As a result, center area 300 and innermost and/or second row of tubes 204 arranged within center area 300 have an increased temperature as compared to other areas of tube assembly 202. Such an increase in temperature results in a reduced margin of a flameholding and/or flashback in such rows of tubes 204 located within center area 300.

To improve the flameholding and/or flashback margin, other fluids are channeled to tube assembly 202. More specifically, in the exemplary embodiment, when fuel is supplied to tube assembly 202, fluids, such as air and/or diluents are channeled through fluid supply member 210 and are also supplied to tube assembly 202. More specifically, fluid is channeled from fluid source 212 (shown in FIG. 2) through fluid supply member 210 to first end portion 214. The fluid is channeled through opening 310 and supplied to tube assembly 202. The fluid deforms the recirculating flow pattern in the center area 300 and some of the fluid is then recirculated to center area 300, wherein the fluid facilitates disrupting the interaction between the combustion product circulating in center area 300 and the combustible mixture from tubes 204 and facilitates preventing the contact of hot combustion product to tube outlets (not shown). By substantially reducing such interactions, the temperature of tube assembly 202 is reduced, and the useful life of tube assembly 202 may be lengthened, as well as the useful life of combustor 124 (shown in FIG. 1).

Figure 9:
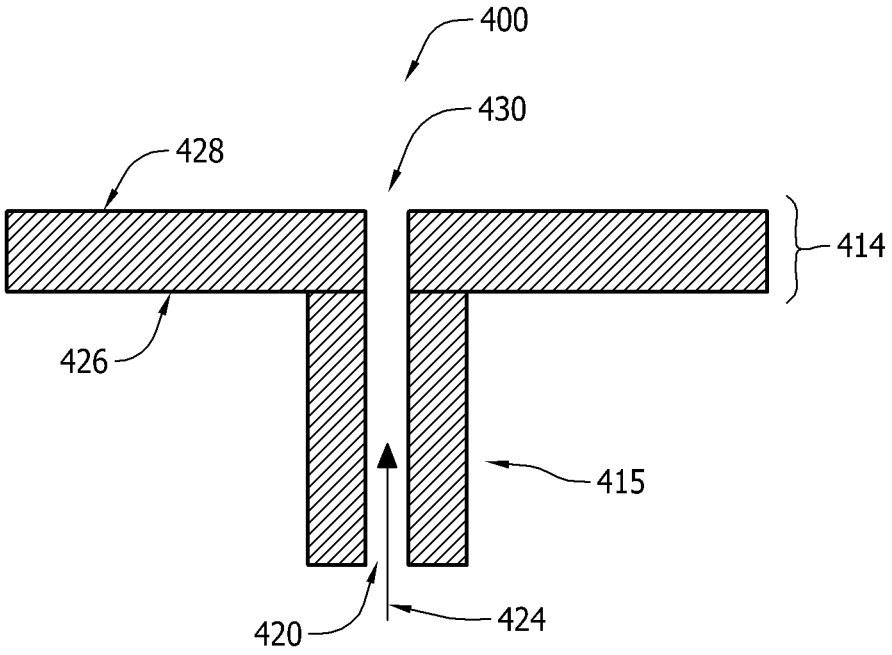
FIG. 9 is an enlarged schematic cross-sectional view of a portion of an alternative fluid supply member that may be used with the injection system shown in FIG. 5 and taken along area 8.

FIG. 9 illustrates a portion of an alternative fluid supply member 400 that may be used with injection system 206 (shown in FIGS. 2 and 5) in place of fluid supply member 210 (shown in FIGS. 2, 5, and 8) and taken along area 8 (shown in FIG. 5). Fluid supply member 400, in the exemplary embodiment, includes a first end portion 414 coupled within tube assembly 202 (shown in FIGS. 2 and 3), a middle portion 415, and a second end portion (not shown) coupled to fluid source 212 (shown in FIG. 2). Middle portion 415 of fluid supply member 400 has a substantially cylindrical shape and is sized to be positioned within fuel delivery pipe 208 (shown in FIGS. 2 and 3). A channel 420 is defined within fluid supply member 400 and provides a flow path, as shown by arrows 424, for the flow of fluid therein.

In the exemplary embodiment, first end portion 414 includes an upstream surface 426 and a downstream surface 428. An opening 430 extends from channel 420. In the exemplary embodiment, upstream 426 and downstream surfaces 428 have a substantially planar surface for facilitating fluid flow within tube assembly 202.

During operation, when fuel is supplied to tube assembly 202, fluids, such as air and/or diluents are also channeled through fluid supply member 400 and are also supplied to tube assembly 202. More specifically, fluid is channeled from fluid source 212 through fluid supply member 400 to first end portion 414. The fluid is channeled through opening 430 and supplied to tube assembly 202.

Figure 10:
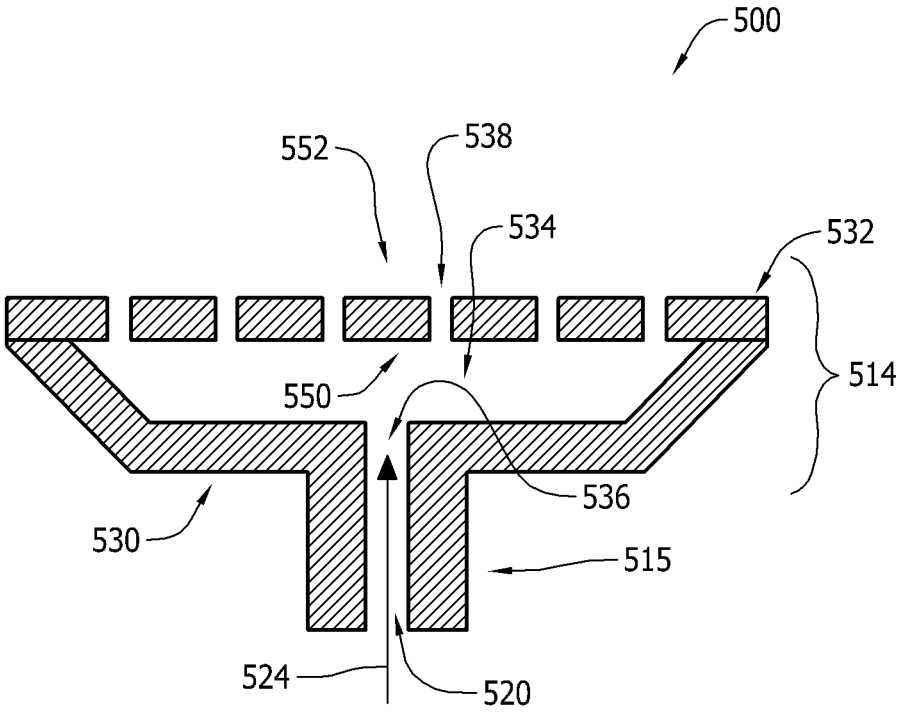
FIG. 10 is an enlarged schematic cross-sectional view of a portion of an alternative fluid supply member that may be used with the injection system shown in FIG. 5 and taken along area 8.

FIG. 10 illustrates a portion of an alternative fluid supply member 500 that may be used with injection system 206 (shown in FIGS. 2 and 5) in place of fluid supply member 210 (shown in FIGS. 2, 5, and 8) and taken along area 8 (shown in FIG. 5). Fluid supply member 500, in the exemplary embodiment, includes a first end portion 514 coupled within tube assembly 202 (shown in FIGS. 2 and 3), a middle portion 515, and a second end portion (not shown) coupled to fluid source 212 (shown in FIG. 2). Middle portion 515 of fluid supply member 500 has a substantially cylindrical shape and is sized to be positioned within fuel delivery pipe 208 (shown in FIGS. 2 and 3). A channel 520 is defined within fluid supply member 500and provides a flow path, as shown by arrows 524, for the flow of fluid therein.

In the exemplary embodiment, first end portion 514 includes an upstream portion 530 coupled to a downstream portion 532 such that a channel 534 is defined therebetween. At least one first opening 538 is defined within and extends radially through downstream portion 532 for facilitating fluid flow to tube assembly 202. At least one second opening 536 is defined within and extends through upstream portion 530 for facilitating fluid flow to channel 534. In the exemplary embodiment, downstream portion includes six first openings 538 in cross-section view of fluid supply member 500. Alternatively, downstream portion may have any number of openings. In the exemplary embodiment, downstream portion 532 also has a first surface 550 and a second surface 552. First 550 and second surface 552 have a substantially planar surface for facilitating fluid flow within tube assembly 202.

During operation, when fuel is supplied to tube assembly 202, fluids, such as air and/or diluents are channeled through fluid supply member 500 and are also supplied to tube assembly 202. More specifically, fluid is channeled from fluid source 212 through fluid supply member 500 to first end portion 514. The fluid is channeled through second opening 536 and supplied to channel 534. Fluid is then channeled to first openings 538 and supplied to tube assembly 202.

As compared to known apparatus and systems that are used with turbine engines, the above-described fuel injection assembly may be used with turbine engines to facilitate reducing the temperature generated within fuel injection assembly. More specifically, the fuel injection assembly includes a plurality of tube assemblies, wherein each of the tube assemblies include an upstream portion and a downstream portion. Each of the tube assemblies include a plurality of tubes that extend from the upstream portion to the downstream portion or from the upstream portion through the downstream portion. At least one injection system is coupled to at least one tube assembly of the plurality of tube assemblies. The injection system includes a fluid supply member that extends from a fluid source to the downstream portion of the tube assembly. The fluid supply member includes a first end portion located in the downstream portion of the tube assembly, wherein the first end portion has at least one first opening for channeling fluid through the tube assembly to facilitate reducing a temperature therein. More specifically, channeling the fluid to at least one of the tube assemblies facilitates reducing the temperature in the center area of tube assembly and of the tubes positioned within the center area, and reducing the probability of or preventing flashbacks and/or flameholdings within the tube.

Exemplary embodiments of a fuel injection assembly and method of assembling same are described above in detail. The fuel injection assembly and method of assembling same are not limited to the specific embodiments described herein, but rather, components of the fuel injection assembly and/or steps of the injection assembly may be utilized independently and separately from other components and/or steps described herein. For example, the fuel injection assembly may also be used in combination with other machines and methods, and is not limited to practice with only a turbine engine as described herein. Rather, the exemplary embodiment can be implemented and utilized in connection with many other systems.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A fuel injection assembly for use in a turbine engine, said fuel injection assembly comprising:

a plurality of tube assemblies wherein each of said plurality of tube assemblies comprises an upstream portion and a downstream portion, each of said plurality of tube assemblies further comprises a plurality of tubes that extend from one of said upstream portion to said downstream portion and said upstream portion through said downstream portion; and at least one injection system coupled to at least one tube assembly of said plurality of tube assemblies, wherein said at least one injection system comprises a fluid supply member that extends from a fluid source to said downstream portion of said at least one tube assembly, said fluid supply member comprises a first end portion located in said downstream portion of said at least one tube assembly, wherein said first end portion comprises at least one first opening for channeling fluid through said at least one tube assembly to facilitate reducing a temperature therein, and wherein said first end portion further comprises one of the following:

(i) an upstream surface and a downstream surface, said downstream surface has a substantially concave shape, said at least one first opening extends from said downstream surface to said upstream surface; and (ii) an upstream portion and a downstream portion coupled to said upstream portion such that a channel is defined therebetween, wherein said first end portion comprises at least one second opening that extends through said upstream portion of said first end portion, said at least one first opening extends through said downstream portion of said first end portion.

2. A fuel injection assembly in accordance with claim 1, wherein said at least one injection system further comprises a fuel delivery pipe, said fluid supply member is positioned at least partially within said fuel delivery pipe.

3. A fuel injection assembly in accordance with claim 1, wherein said fluid supply member further comprises a second end portion and a middle portion, the fluid may be channeled to said at least one first opening from at least one of said first end portion, middle portion, and said second end portion.

4. A fuel injection assembly in accordance with claim 1, wherein said fluid supply member channels at least one of a diluent, an inert gas, and air to said at least one tube assembly.

5. A turbine engine, said turbine engine comprising:

a compressor;

a combustion assembly coupled downstream from said compressor, wherein said combustion assembly comprises at least one combustor comprising a fuel injection assembly comprising:

a plurality of tube assemblies wherein each of said plurality of tube assemblies comprises an upstream portion and a downstream portion, each of said plurality of tube assemblies further comprises a plurality of tubes that extend from one of said upstream portion to said downstream portion and said upstream portion through said downstream portion; and at least one injection system coupled to at least one tube assembly of said plurality of tube assemblies, wherein said at least one injection system comprises a fluid supply member that extends from a fluid source to said downstream portion of said at least one tube assembly, said fluid supply member comprises a first end portion located in said downstream portion of said at least one tube assembly, wherein said first end portion comprises at least one first opening for channeling fluid through said at least one tube assembly to facilitate reducing a temperature therein, and wherein said first end portion further comprises one of the following:

(i) an upstream surface and a downstream surface, said downstream surface has a substantially concave shape, said at least one first opening extends from said downstream surface to said upstream surface; and (ii) an upstream portion and a downstream portion coupled to said upstream portion such that a channel is defined therebetween, wherein said first end portion comprises at least one second opening that extends through said upstream portion of said first end portion, said at least one first opening extends through said downstream portion of said first end portion.

6. A turbine engine in accordance with claim 5, wherein said at least one injection system further comprises a fuel delivery pipe, said fluid supply member is positioned at least partially within said fuel delivery pipe.

7. A turbine engine in accordance with claim 5, wherein said fluid supply member further comprises a second end portion and a middle portion, the fluid may be channeled to said at least one first opening from at least one of said first end portion, middle portion, and said second end portion.

8. A turbine engine in accordance with claim 5, wherein said fluid supply member channels at least one of a diluent, an inert gas, and air to said at least one tube assembly.

9. A method for assembling a fuel injection assembly for use with a turbine engine, said method comprising:

coupling a plurality of tube assemblies within a combustor, wherein each of said plurality of tube assemblies includes an upstream portion and a downstream portion, each of the plurality of tube assemblies includes a plurality of tubes that extend from one of said upstream portion to said downstream portion and said upstream portion through said downstream portion; and coupling at least one injection system to at least one tube assembly of the plurality of tube assemblies, wherein the at least one injection system includes a fluid supply member that extends from a fluid source to the downstream portion of the at least one tube assembly, the fluid supply member includes a first end portion that is located in the downstream portion of the at least one tube assembly, wherein the first end portion includes at least one first opening for channeling fluid through the at least one tube assembly to facilitate reducing a temperature therein, and wherein the fluid supply member includes one of the following:

(i) a first end portion that includes an upstream surface and a downstream surface, the downstream surface has a substantially concave shape, the at least one first opening extends from the downstream surface to the upstream surface; and (ii) a first end portion that includes an upstream portion and a downstream portion that is coupled to the upstream portion such that a channel is defined therebetween, the first end portion includes at least one second opening that extends through the upstream portion of the first end portion and the at least one first opening extends through the downstream portion of the first end portion.

10. A method in accordance with claim 9, wherein coupling at least one injection system further comprises coupling at least one injection system to at least one tube assembly of the plurality of tube assemblies, wherein the at least one injection system includes a fuel delivery pipe, the fluid supply member is positioned at least partially within the fuel delivery pipe.

11. A method in accordance with claim 9, wherein coupling at least one injection system further comprises coupling at least one injection system to at least one tube assembly of the plurality of tube assemblies, wherein the fluid supply member includes a first end portion that includes at least one first opening for channeling at least one of a diluent, an inert gas, and air to the at least one tube assembly to facilitate reducing a temperature therein.

* * * * *